US009512549B2

(12) United States Patent
Im et al.

(10) Patent No.: US 9,512,549 B2
(45) Date of Patent: Dec. 6, 2016

(54) WASHING MACHINE USING ULTRASONIC VIBRATIONS

(75) Inventors: Dae Yeong Im, Jeollanam-do (KR); Hyun Rok Cha, Gwangju (KR); Chang Seog Kang, Gwangju (KR); Hyoung Uk Nam, Gwangju (KR); Chang Youn Kang, Gwangju (KR)

(73) Assignee: KOREA INSTITUTE OF INDUSTRIAL TECHNOLOGY (KR)

( * ) Notice: Subject to any disclaimer, the term of this patent is extended or adjusted under 35 U.S.C. 154(b) by 364 days.

(21) Appl. No.: 13/504,706

(22) PCT Filed: Sep. 12, 2011

(86) PCT No.: PCT/KR2011/006652

§ 371 (c)(1),
(2), (4) Date: Sep. 28, 2012

(87) PCT Pub. No.: WO2012/077892

PCT Pub. Date: Jun. 14, 2012

(65) Prior Publication Data

US 2013/0255326 A1 Oct. 3, 2013

(30) Foreign Application Priority Data

Dec. 8, 2010 (KR) ..... 10-2010-0124740

(51) Int. Cl.

| | |
|---|---|
| ***D06F 15/00*** | (2006.01) |
| ***D06F 19/00*** | (2006.01) |
| ***D06F 35/00*** | (2006.01) |
| ***D06F 39/00*** | (2006.01) |
| ***D06F 39/04*** | (2006.01) |

(52) U.S. Cl.

CPC ..... *D06F 19/00* (2013.01); *D06F 15/00* (2013.01); *D06F 35/00* (2013.01); *D06F 39/003* (2013.01); *D06F 39/04* (2013.01)

(58) Field of Classification Search

CPC .... D06F 19/00; D06F 35/001; D06F 35/002; D06F 15/00; D06F 13/00; D06F 17/00

USPC ..... 68/130, 5 R, 3 SS

See application file for complete search history.

(56) References Cited

U.S. PATENT DOCUMENTS

| | | | | |
|---|---|---|---|---|
| 599,262 | A * | 2/1898 | Selle | 68/72 |
| 1,452,096 | A * | 4/1923 | Ross | D06F 15/00 68/130 |

(Continued)

FOREIGN PATENT DOCUMENTS

| | | | |
|---|---|---|---|
| CN | 2407019 | Y * | 11/2000 |
| CN | 1311367 | A * | 9/2001 |

(Continued)

OTHER PUBLICATIONS

Machine Translation of CN 1311367 A, dated Sep. 2001.*

(Continued)

*Primary Examiner* — Michael Barr
*Assistant Examiner* — Kevin G Lee
(74) *Attorney, Agent, or Firm* — Levenfeld Pearlstein, LLC

(57) ABSTRACT

A washing machine using ultrasonic vibrations, which can allow a user to at home easily and efficiently wash the laundry that needs hand washing or dry-cleaning. The washing machine includes: a body having an inner space of a predetermined volume; a washing tub installed in the body, with a water supply pipe connected to a side of the washing tub so as to supply washing water or a detergent into the tub and with a drain pipe connected to the side of the tub at a position opposite that of the water supply pipe so as to drain used water or used detergent; a cover mounted to a predetermined portion of the body so as to open or close the tub; and an ultrasonic generator installed in at least one predetermined portion of the tub so as to apply ultrasonic vibrations to a laundry contained in the tub.

5 Claims, 3 Drawing Sheets

(56) References Cited

U.S. PATENT DOCUMENTS

| | | | | | |
|---|---|---|---|---|---|
| 2,235,094 | A | * | 3/1941 | Walker | D06F 15/00 68/122 |
| 2,258,051 | A | * | 10/1941 | Gaultier | D06F 15/00 192/24 |
| 4,159,632 | A | * | 7/1979 | Grantham | D06F 15/00 271/258.01 |
| 5,307,649 | A | * | 5/1994 | Lim et al. | 68/12.05 |
| 5,617,746 | A | * | 4/1997 | Hong et al. | 68/21 |

FOREIGN PATENT DOCUMENTS

| | | | | |
|---|---|---|---|---|
| CN | 2795254 | Y | * | 7/2006 |
| KR | 10-1994-0011701 | A | | 6/1994 |
| KR | 19940011701 | A | * | 6/1994 |
| KR | 10-1997-0075034 | A | | 12/1997 |
| KR | 20-0116461 | | | 4/1998 |

OTHER PUBLICATIONS

Machine Translation of CN 2795254 Y, dated Jul. 2006.*

Machine Translation of CN 2407019 Y, dated Nov. 2000.*

Machine Translation of KR 19940011701 A, dated Jun. 1994.*

Google and EPO machine translation of CN 1311367 A, dated Sep. 2001.*

International Search Report for PCT/KR2011/006652, dated Apr. 9, 2012.

* cited by examiner

WASHING MACHINE USING ULTRASONIC VIBRATIONS

CROSS-REFERENCE TO RELATED APPLICATIONS

This is a National Stage Application of International Patent Application No. PCT/KR2011/006652, filed Sep. 8, 2011, which claims the benefit of and priority to Korean Patent Application No. 10-2010-0124740, filed. Dec. 8, 2010, the contents of which are incorporated full by reference herein.

TECHNICAL FIELD

The present invention relates, in general, to a washing machine using ultrasonic vibrations and, more particularly, to a washing machine using ultrasonic vibrations, which can promote the washing action using ultrasonic cavitation effects so that it can perform non-contact washing and can wash both sides of a textile fabric at the same time because of decomposition effects and accordingly, efficiently washes laundry without damaging the fabric and allows a user to easily dry-clean at home those fabrics that must not be washed in water.

BACKGROUND ART

In recent years, the generalization of domestic electric appliances has made it so that garments are preferably washed using electric washing machines. However, some kinds of garments are not suitable to washing in washing machines due to the characteristics of the fabric so that they need to be hand-washed. Also, it is impossible to wash some other kinds of garments using water and general detergent and so they need to be dry-cleaned.

Hand washing requires substantial physical work and time and some unskilled people may fail to appropriately hand-wash the laundry and, accordingly, may damage the laundry. Also, dry-cleaning requires specialized machines and facilities so that it is almost impossible to dry-clean at home and, accordingly, laundry in need of dry-cleaning must be cleaned by a specialized cleaning shop.

However, a user must pay to use a specialized cleaning shop and, furthermore, must bring the laundry to the shop and pick up the cleaned laundry from the shop, so that cleaning using the specialized cleaning shop causes the user inconvenience and the user unnecessarily wastes time. Further, various chemicals that are used in such specialized cleaning shops are harmful to the human body and fail to realize high washing efficiency.

DISCLOSURE

Technical Problem

Accordingly, the present invention has been made keeping in mind the above problems occurring in the related art, and is intended to provide a washing machine using ultrasonic vibrations, which can allow a user to at home easily and efficiently wash laundry that needs to be hand-washed or dry-cleaned.

Technical Solution

In an aspect, the present invention provides a washing machine using ultrasonic vibrations including: a body having an inner space of a predetermined volume; a washing tub installed in the body, with a water supply pipe being connected to a side of the washing tub so as to supply washing water or a detergent into the washing tub and with a drain pipe connected to the side of the washing tub at a position opposite that of the water supply pipe so as to drain used water or used detergent; a cover mounted to a predetermined portion of the body so as to open or close the washing tub; and an ultrasonic generator installed in at least one predetermined portion of the washing tub so as to apply ultrasonic vibrations to a laundry contained in the washing tub.

The washing machine may further include: an air discharge unit installed in the washing tub and including a plurality of nozzles that are connected to an air supply and discharge air, thereby producing air bubbles in the water or the detergent inside the washing tub.

Here, the air supply of the air discharge unit may be a compressor that is installed in a predetermined portion of the body so as to compress air and supply the compressed air.

Further, the air discharge unit may have a flat block structure that is installed at a location around a bottom of the washing tub, with an air supply passage being formed in the block structure in such a way that the passage communicates with the nozzles.

The washing tub may be provided therein with both a temperature sensor for sensing a temperature of the water or the detergent and a heater for heating the water or the detergent to a preset temperature according to a signal output from the temperature sensor.

The washing machine may further include a beating unit that is installed in the cover and is provided with a beater in such a way that when the cover is closed, the beater is placed inside the washing tub so as to mechanically beat the laundry.

The beating unit may include: the beater installed in such a way that the beater can reciprocate in a direction toward an interior of the washing tub; and a drive unit for operating the beater and reciprocating the beater.

The drive unit may include: a spring for elastically biasing the beater in one of reciprocating directions of the beater; and an eccentric cam rotated by a motor so as to bias the beater in a direction opposite to the spring-biased direction of the beater.

Further, the beating unit may be installed in such a way that the beater can reciprocate in directions parallel to a moving direction of the laundry during a mashing operation.

Advantageous Effects

The present invention provides the following advantages.

1) The method used by the washing machine to wash the laundry may be a non-contact washing method that uses both ultrasonic vibrations that are generated by the ultrasonic generator and air bubbles generated by the air discharge unit, so that the washing machine allows a user to at home use water or a fat-soluble detergent and, accordingly, to efficiently clean laundry that needs hand washing or dry-cleaning, in addition to cleaning machine-washable laundry.

2) The washing machine can promote the decomposition of contaminants using mechanical impact generated by the beating unit, thereby further increasing the washing efficiency.

3) In the washing machine, the beating unit performs its beating motion in directions parallel to the moving direction of the laundry that is being moved by both the ultrasonic vibrations and the discharged air bubbles, thereby increasing the washing efficiency while reducing the frictional damage done to the laundry.

MODE FOR INVENTION

The above and other objects, features and further advantages of the present invention will be more clearly understood from the following detailed description. A preferred embodiment of the present invention will be described in detail with reference to the accompanying drawings.

Figure 1:
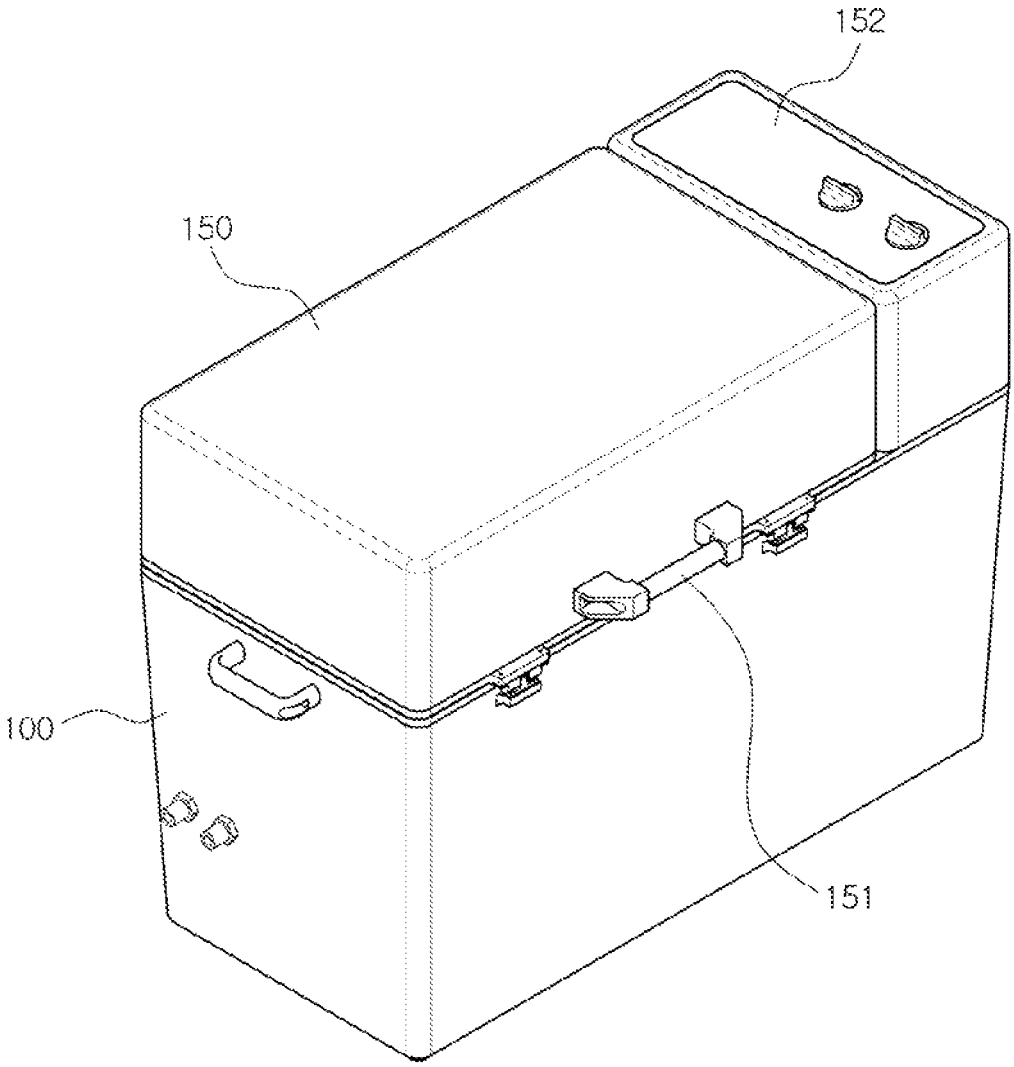
FIG. 1 is a perspective view illustrating the appearance of a washing machine using ultrasonic vibrations according to an embodiment of the present invention.
Figure 2:
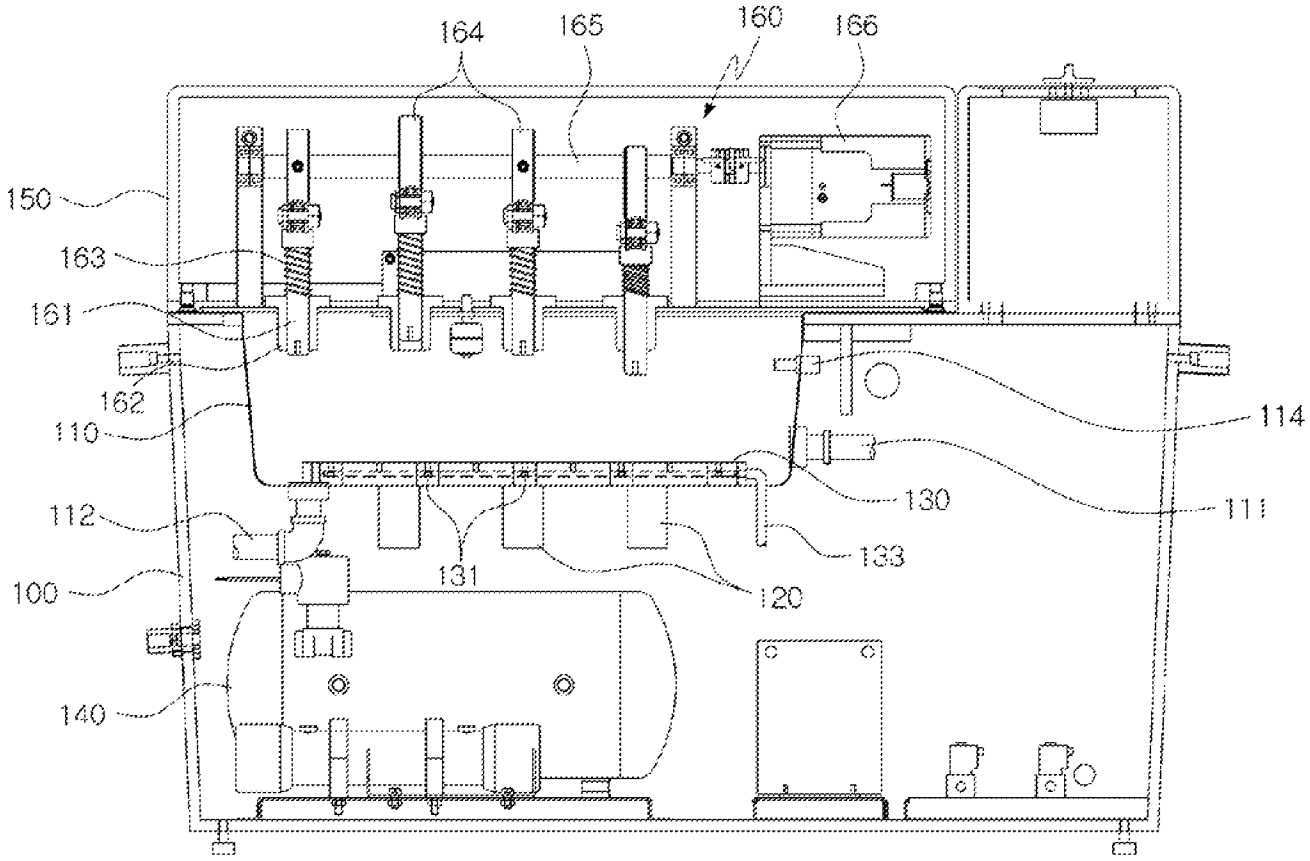
FIG. 2 is a front sectional view illustrating the internal construction of the washing machine according to the present invention shown in FIG. 1.
Figure 3:
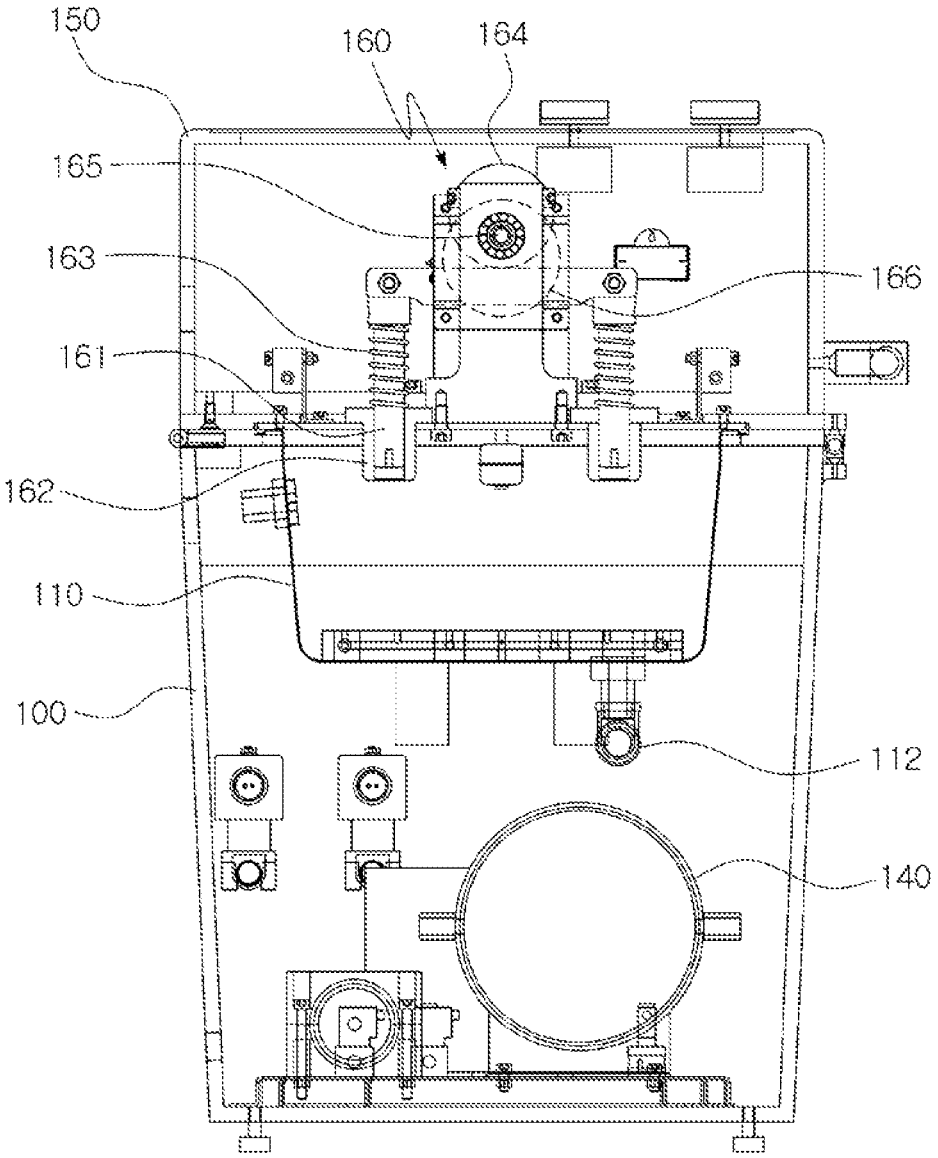
FIG. 3 is a side sectional view illustrating the internal construction of the washing machine according to the present invention shown in FIG. 1.

FIG. 1 is a perspective view illustrating the appearance of a washing machine using ultrasonic vibrations according to an embodiment of the present invention. FIGS. 2 and 3 are a front sectional view and a side sectional view illustrating the internal construction of the washing machine according to the present invention shown in FIG. 1.

As shown in the drawings, the washing machine according to the present invention includes a washing tub 110 which is installed in a box-shaped body 100 that has an inner space of a predetermined volume. The top of the body 100 is covered with an openable cover 150 so that the washing tub 110 can be closed from the outside. Further, a controller 152 is provided on the top of the body 100 so as to control the operation of the washing machine.

The washing tub 110 has a container shape that is open at the top thereof so that the laundry such as garments, can be put into or taken out of the washing tub. Connected to an end wall of the washing tub is a water supply pipe 111, through which washing water is supplied from a water supply source into the washing tub. A drain pipe 112 is connected to an opposite end wall of the washing tub so as to drain the used water from the washing tub to the outside. A water supply control valve (not shown) and a water drain control valve (not shown) are mounted on the water supply pipe 111 and the water drain pipe 112, respectively, so as to control the water supply and the water drain.

An ultrasonic generator 120 is mounted to the lower surface of the bottom wall of the washing tub 110 so as to generate ultrasonic waves and generate vibrations in the washing tub 110.

An air discharge unit 130 is installed in the lower portion inside the washing tub 110 and discharges air into the washing water that is in the washing tub 110, thereby producing air bubbles in the water. The air discharge unit 130 may be variously configured in such a way that the unit 130 has a nozzle that is connected to an outside air supply by a pipe. In the embodiment shown in the drawings, the air discharge unit 130 is configured to form a flat block structure; the block structure has an air supply passage 132 therein and a plurality of nozzles 131 are provided in an upper surface of the block structure so as to communicate with the air supply passage 132.

Further, installed in the washing tub 110 are a water level sensor 114 for sensing the level of water in the washing tub 110, a heater (not shown) for heating the water in the washing tub and a temperature sensor (not shown) for sensing the temperature of the water.

A compressor 140 is installed in the lower portion of the body 100 and supplies air into the air discharge unit 130. The compressor 140 compresses outside air to an appropriate pressure and supplies the compressed air into the air supply passage 132, thereby causing the compressed air to be discharged through the nozzles 131. Further, an air supply control valve (not shown) for controlling the air supply is mounted to an air supply pipe that extends between the compressor 140 and the air discharge unit 130.

A handle 151 is mounted to the outer surface of the cover 150 so as to allow a user to manipulate the cover when opening or closing the cover. A beating unit 160 is installed in the cover 150 so as to beat the laundry and thereby increase the washing efficiency.

The beating unit 160 is provided with a beater 161. When the cover 150 is closed, the beater 161 is placed in the upper portion of the washing tub 110 and beats the laundry. The beater 161 may be configured to have a fixed-structure so that the laundry can collide on the beater when it moves in the washing tub 110. However, it is preferred that the beater 161 be configured to have a movable structure that can be reciprocated by a drive unit and can actively beat the laundry.

In the embodiment shown in the accompanying drawings, the beating unit 160 is provided with a rod-shaped beater 161 that is installed in such a way that the beater 161 can move upwards and downwards under the guide of a guide holder 162. The beater 161 is made to perform a vertical reciprocating motion by the drive unit that includes a spring 163 for elastically biasing the beater 161, a drive shaft 165 having an eccentric cam 164, and a drive motor 166 for rotating the drive shaft 165. The spring 163 is installed in such a way that the spring 163 can elastically bias the beater 161 upwards so that the beater 161 can restore its upper position. The eccentric cam 164 is installed in such a way that the cam 164 makes contact with the upper end of the beater 161 so that when the cam 164 rotates, the cam can move the beater 161 downwards.

The operation of the ultrasonic washing machine according to the present invention will be described below.

When a user selects a desired washing condition and inputs a start signal using a control unit that is provided in the controller 152 after putting the laundry into the washing tub 110, the water supply control valve is opened and the water drain control valve is closed, and water is supplied into the washing tub 110. In the above state, the heater is operated and heats the water to a preset water temperature. When the water level sensor 114 senses that the level of water has reached a predetermined amount, washing mode is started.

In other words, the ultrasonic generator 120 is operated and applies ultrasonic vibrations to the laundry through the water so that the washing operation is performed. During the washing operation, air is supplied from the compressor 140 and is discharged into the water through respective nozzles 131 of the air discharge unit 130, thereby forming air bubbles in the water and promoting the washing action. Further, because the heater heats the water, the washing efficiency can be further increased.

Here, the beating unit 160 is operated and further promotes the washing action. Described in detail, the drive shaft 165 is rotated by the motor 166 so that respective beaters 161 vertically reciprocate by both respective eccentric cams 164 and respective springs 163 and repeatedly beat the laundry, thereby further efficiently decomposing and removing contaminants from the laundry.

As described above, the washing machine of the present invention washes the laundry using both the ultrasonic vibrations that are generated by the ultrasonic generator 120 and the air bubbles generated by the air discharge unit 130, so that the washing machine can realize high washing efficiency while minimizing damage to the laundry. The washing efficiency of the washing machine can be further increased by the heater that heats the water.

Further, because the beating unit 160 mechanically beats the laundry, the washing efficiency can be further increased. Further, due to both the ultrasonic vibrations that are generated by the ultrasonic generator 120 and the air bubbles generated by the air discharge unit 130, the laundry can repeatedly move upwards and downwards. Here, the beaters 161 beat the laundry while moving in directions parallel to the moving direction of the laundry, thereby increasing the washing efficiency while reducing frictional damage to the laundry.

In addition to the rod-shaped structure that is shown in the drawings, the beaters 161 may be variously configured so long as they can apply mechanical impact to the laundry. Further, the drive unit may be variously configured if it has a power transmission structure capable of transmitting the drive power of the motor 166 and reciprocating the beaters 161.

Further, although the embodiment has been disclosed such that the present invention is adapted to the structure of a stand-up washing machine having a washing tub, the present invention can be adapted to the structure of a drum washing machine without being limited to the vertical washing machine. Further, although the embodiment has been disclosed such that the washing machine performs the washing operation using water, the washing machine can perform the washing operation using a fat-soluble detergent so that the washing machine can efficiently clean (dry-clean) the laundry that needs to not be washed in water.

Although the embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A washing machine using ultrasonic vibrations, comprising:

a body having an inner space of a predetermined volume;

a washing tub installed in the body, with a water supply pipe being connected to a side of the washing tub so as to supply washing water or a detergent into the washing tub and with a drain pipe connected to the side of the washing tub at a position opposite that of the water supply pipe so as to drain used water or used detergent;

a cover mounted to a predetermined portion of the body so as to open or close the washing tub;

an ultrasonic generator installed in at least one predetermined portion of the washing tub so as to apply ultrasonic vibrations to a laundry contained in the washing tub; and a beating unit comprising a plurality of beaters, a plurality of eccentric cams, and a drive unit for operating and reciprocating the plurality of beaters, wherein the beating unit is installed in the cover in such a way that the plurality of beaters are placed inside the washing tub when the cover is closed so as to mechanically beat the laundry, wherein each of the plurality of beaters is arranged in a guide holder and guided by the guide holder to reciprocate in directions parallel to a moving direction of the laundry to mechanically beat the laundry during a washing operation, wherein the drive unit comprises a spring positioned on each of the plurality of guide holders for elastically biasing each of the plurality of beaters in one of reciprocating directions of the beater, and wherein each of the plurality of eccentric cams is arranged on a driver shaft of a motor and configured to be rotated by the motor so as to bias the beater in a direction opposite to the spring-biased direction of the beater, wherein the plurality of beaters includes at least a pair of beaters connected by a bar and configured to reciprocate simultaneously together by an off-center rotational motion of one of the plurality of eccentric cams arranged to be in contact with the bar, wherein the beater repeatedly beats the laundry so as to decompose and remove contaminants from the laundry.

2. The washing machine using ultrasonic vibrations of claim 1, further comprising:

an air discharge unit installed in the washing tub and including a plurality of nozzles that are connected to an air supply and discharge air, thereby producing air bubbles in the water or the detergent inside the washing tub.

3. The washing machine using ultrasonic vibrations of claim 2, wherein the air supply of the air discharge unit comprises a compressor that is installed in a predetermined portion of the body so as to compress air and supply the compressed air.

4. The washing machine using ultrasonic vibrations of claim 2, wherein the air discharge unit has a flat block structure that is installed at a location around a bottom of the washing tub, with an air supply passage being formed in the block structure in such a way that the passage communicates with the nozzles.

5. The washing machine using ultrasonic vibrations of claim 1, wherein the washing tub is provided therein with both a temperature sensor for sensing a temperature of the water or the detergent and a heater for heating the water or the detergent to a preset temperature according to a signal output from the temperature sensor.

* * * * *